US009347613B2

(12) United States Patent
Wang

(10) Patent No.: US 9,347,613 B2
(45) Date of Patent: May 24, 2016

(54) AIR PUMP WITH A BIASABLE HEAD

(71) Applicant: BETO ENGINEERING AND MARKETING CO., LTD., Taichung (TW)

(72) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 146 days.

(21) Appl. No.: 13/899,004

(22) Filed: May 21, 2013

(65) Prior Publication Data

US 2014/0345747 A1 Nov. 27, 2014

(51) Int. Cl.
*F17C 5/06* (2006.01)
*F04B 33/00* (2006.01)

(52) U.S. Cl.
CPC ..... *F17C 5/06* (2013.01); *F04B 33/005* (2013.01)

(58) Field of Classification Search
CPC ..... F04B 33/00; F04B 33/005; F17C 5/06
USPC ..... 417/545, 547
See application file for complete search history.

(56) References Cited

U.S. PATENT DOCUMENTS

| | | | | |
|---|---|---|---|---|
| 1,504,945 | A * | 8/1924 | Dempsey | F16L 35/00 138/110 |
| 4,163,573 | A * | 8/1979 | Yano | 285/148.13 |
| 4,319,070 | A * | 3/1982 | Imai et al. | 174/15.7 |
| 4,460,140 | A * | 7/1984 | Ramazzotti et al. | 248/75 |
| 5,035,440 | A * | 7/1991 | Chappell | B62J 11/02 280/201 |
| 6,893,232 | B2 * | 5/2005 | Wu | 417/547 |
| 2012/0080099 | A1 * | 4/2012 | Wang | B60S 5/043 137/223 |
| 2013/0136625 | A1 * | 5/2013 | Chuang | F04B 33/005 417/234 |

* cited by examiner

*Primary Examiner* — Peter J Bertheaud
*Assistant Examiner* — Dominick L Plakkoottam
(74) *Attorney, Agent, or Firm* — Muncy, Geissler, Olds & Lowe, P.C.

(57) ABSTRACT

An air pump with a biasable head is disclosed to include a head connectable to an air valve of an inflatable object, a cylinder providing an air output end, and a flexible air guide tube haying a front end thereof fixedly connected to the head and an opposite rear end thereof connected to the air output end of the cylinder. Subject to the arrangement of the flexible air guide tube, the air pump does not vibrate the connected air valve during its operation. Further, the flexible air guide tube has a short length, and can positively maintain the head in connection with the cylinder during delivery, avoiding disconnection of the head from the cylinder.

1 Claim, 3 Drawing Sheets

AIR PUMP WITH A BIASABLE HEAD

BACKGROUND OF THE INVENTION

1. Field of the Invention

The present invention relates air pump technology and more particularly, to an air pump with a biasable head that allows the head of the air pump to be freely biased upward, downward, leftward and rightward.

2. Description of the Related Art

A portable air pump for bicycle generally has the head and the cylinder fixedly connected together. When operating this design of air pump to pump air into the air valve of a bicycle tire, the air valve can be vibrated, causing damage. In order to overcome this problem, a long flexible tube may be used and connected between the head and the cylinder. However, this long flexible tube may be forced away from the cylinder by vibrations during running of the bicycle that carries the air pump. Further, an air pump may be configured to use a head that is made in the form of a universal joint. However, the structural of this design is complicated. Further, the operation of this design of air pump is unsmooth.

SUMMARY OF THE INVENTION

The present invention has been accomplished under the circumstances in view. It is the main object of the present invention to provide an air pump, which does not vibrating the air valve of the tire during application, and prevents disconnection the flexible tube from the cylinder when the bicycle carrying the air pump.

To achieve this and other objects of the present invention, an air pump in accordance with the present invention comprises a head connectable to an air valve of an inflatable object, a cylinder providing an air output end, and a flexible air guide tube having a front end thereof fixedly connected to the head and an opposite rear end thereof connected to the air output end of the cylinder. Subject to the arrangement of the flexible air guide tube, the air pump does not vibrate the connected air valve during its operation. Further, the flexible air guide tube has a short length, and can positively maintain the head in connection with the cylinder during delivery, avoiding disconnection of the head from the cylinder.

DETAILED DESCRIPTION OF THE INVENTION

Figure 1:
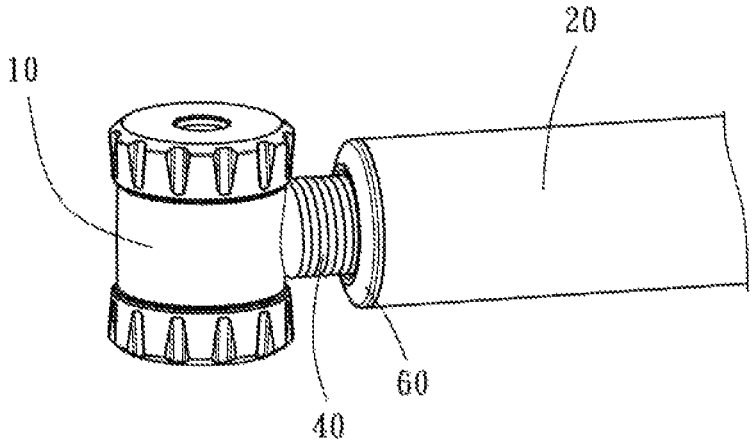
FIG. 1 is an elevational view of an air pump in accordance with the pres invention.
Figure 2:
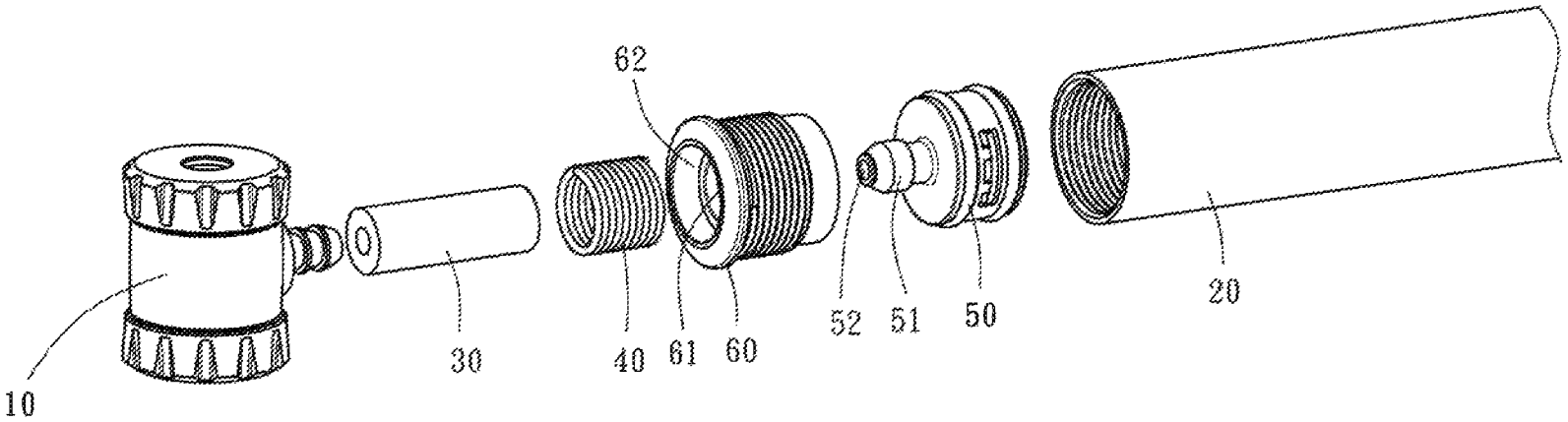
FIG. 2 is an exploded view of the air pump in accordance with the present invention.
Figure 3:
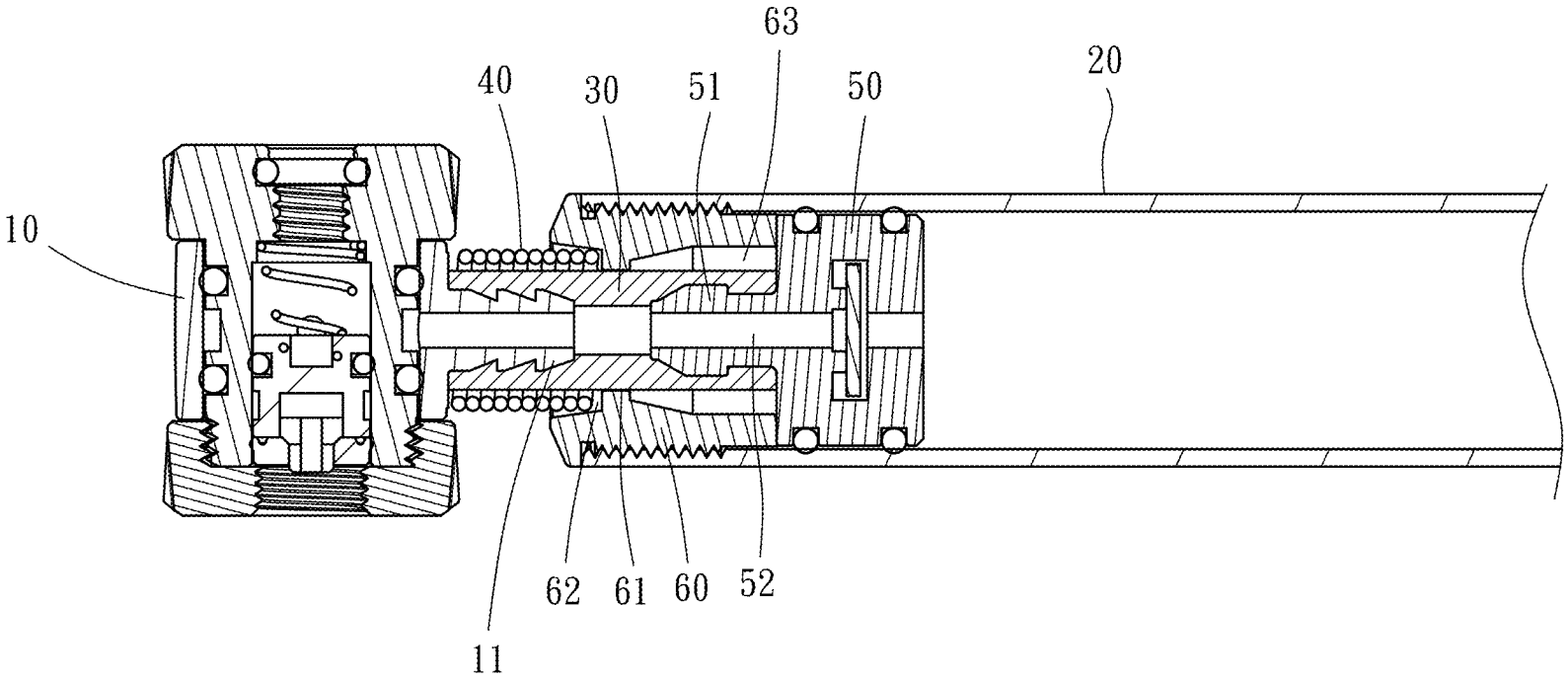
FIG. 3 is a sectional view of FIG. 1.

Referring to FIGS. 1-3, an air pump in accordance with the present invention is shown. As illustrated, the air pump comprises a head 10 connectable to an air valve of an inflatable object, a cylinder 20 providing an air output end, and a flexible air guide tube 30 having its one end, namely, the front end fixedly connected to the head 10 and its other end, namely, the rear end connected to the air output end of the cylinder 20.

The length of the flexible air guide tube 30 must be properly controlled. Preferably, the length of the flexible air guide tube 30 is so arranged that that when the cylinder 20 is lifted horizontally, the flexible air guide tube 30 can hold the head 10 in horizontal. If the strength of the flexible air guide tube 30 is insufficient to support the head 10 in horizontal when the cylinder 20 is lifted horizontally, the head 10 will sag. The sag angle is preferably less than 15 degrees, or most preferably less than 10 degrees. To achieve this object, the flexible air guide tube 30 must have certain strength. Further, the length of the flexible air guide tube 30 is preferably less than 15 cm, or most preferably less than 10 cm. Thus, the air pump can have a better body shape, and its head will not sag when it is lifted horizontally, not giving a feeling of dejection and avoiding vibration of the head 10 during running of the bicycle carrying the air pump.

Except the measure of enhancing the strength of the flexible air guide tube 30, a supplementary device 40, for example, a reinforcing rib, tube or coil can be mounted around the periphery of the flexible air guide tube 30 to enhance the strength of the flexible air guide tube 30 while maintaining the flexible feature of the flexible air guide tube 30. In this embodiment, the flexible air guide tube 30 is a coil spring that protects the flexible air guide tube 30, can be bent with the flexible air guide tube 30, and exhibits a sense of beauty.

Further, a leak-proof member 50 is mounted in the cylinder 20. The leak-proof member 50 comprises a tubular front connection tip 51 located at the center of the front side thereof, and a through hole 52 defined in the tubular front connection tip 51 and extending through opposing front and rear sides thereof. The rear end of the flexible air guide tube 30 is fixedly connected to the tubular front connection tip 51 of the leak-proof member 50. Further, an end cap 60 is fastened to the front open end of the cylinder 20, defining therein a through hole 61 for the insertion of the flexible air guide tube 30 and a recessed portion 62 located at the front end thereof around the through hole 61 for accommodating one end of the supplementary device 40.

According to the present invention, the head 10 has an insertion tube 11 inserted into the flexible air guide tube 30 and extending to a location within the recessed portion 60 of the end cap 60. The flexible air guide tube 30 supports the head 10 and allows the head 10 to be freely biased upward, downward, leftward and rightward. Further, subject to the strength of the flexible air guide tube 30 or the arrangement of the supplementary device 40 to reinforce the strength of the flexible air guide tube 30, the head 10 does not sag and the air pump is kept in shape when the air pump is horizontally lifted, and the head 10 of the air pump will not vibrate when the bicycle carrying the air pump is running.

What is claimed is:

1. An air pump, comprising:

a head connectable to an air valve of an inflatable object;

a cylinder providing an air output end;

a flexible air guide tube having a front end thereof fixedly connected to said head and an opposite rear end thereof connected to said air output end of said cylinder;

a supplementary device mounted around said flexible air guide tube, the supplementary device being a coil spring; and an end cap fastened to said air output end of said cylinder, said end cap defining a through hole for the insertion of said flexible air guide tube and a recessed portion at a front side thereof around said through hole of said end cap for accommodating one end of said supplementary device, wherein said cylinder has a leak-proof member mounted therein, said leak-proof member comprising a tubular front connection tip located at a front side thereof and a through hole defining in said tubular front connection tip and extending through opposing front and rear sides of said leak-proof member; said opposite rear end of the flexible air guide tube connected to said tubular front connection tip of said leak-proof member, the end cap is located inside the cylinder, end cap is provided at a rear side thereof with a cavity within which the tubular front connection tip of the leak-proof member in located, the head has an insertion tube inserted into the flexible air guide tube and extending to a location within the recessed portion of the end cap, the coil spring has a first end stopped against head, a second end opposite to the first end and stopped against the end cap, and a plurality of coils that are abutted together one after another, and the end cap has an inner end against which he leak proof member is stationarily stopped.

* * * * *